US010899147B2

(12) United States Patent
Ozawa

(10) Patent No.: US 10,899,147 B2
(45) Date of Patent: Jan. 26, 2021

(54) PRINTING DEVICE, CONTROL METHOD, AND RECORDING MEDIUM

(71) Applicant: CASIO COMPUTER CO., LTD., Tokyo (JP)

(72) Inventor: Takeo Ozawa, Mitaka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/278,577

(22) Filed: Feb. 18, 2019

(65) Prior Publication Data

US 2019/0291478 A1 Sep. 26, 2019

(30) Foreign Application Priority Data

Mar. 22, 2018 (JP) ..... 2018-053772

(51) Int. Cl.

| | |
|---|---|
| ***B41J 11/66*** | (2006.01) |
| ***B41J 3/407*** | (2006.01) |
| ***B41J 11/70*** | (2006.01) |
| ***B41J 13/00*** | (2006.01) |

(52) U.S. Cl.

CPC ..... *B41J 11/663* (2013.01); *B41J 3/4075* (2013.01); *B41J 11/703* (2013.01); *B41J 13/0009* (2013.01)

(58) Field of Classification Search

CPC ..... B41J 11/663; B41J 11/666; B41J 11/703
See application file for complete search history.

(56) References Cited

U.S. PATENT DOCUMENTS 6,142,688 A 11/2000 Saito
9,487,035 B2 11/2016 Wakayama
2013/0149019 A1* 6/2013 Sugimura ..... B41J 11/42 400/621

FOREIGN PATENT DOCUMENTS

| | | | |
|---|---|---|---|
| JP | H0825707 | A | 1/1996 |
| JP | H11227276 | A | 8/1999 |
| JP | H11320993 | A | 11/1999 |
| JP | 2004216692 | A | 8/2004 |
| JP | 2006150833 | A | 6/2006 |
| JP | 2012179882 | A | 9/2012 |
| JP | 2016137627 | A | 8/2016 |

OTHER PUBLICATIONS

Japanese Office Action (and English language translation thereof) dated Jan. 14, 2020 issued in Japanese Application No. 2018-053772.

Chinese Office Action (and English language translation thereof) dated Jun. 1, 2020 issued in Chinese Application No. 201910196467.0.

* cited by examiner

*Primary Examiner* — Lam S Nguyen
(74) *Attorney, Agent, or Firm* — Holtz, Holtz & Volek PC

(57) ABSTRACT

A printing device 1 includes a platen roller 7 which feeds a thermal tape 42, a thermal head 8 which performs printing on the thermal tape 42, a half cutter 10 which performs a half cut on the thermal tape 42, and a control circuit 12. After the half cut is performed, the control circuit 12 controls the platen roller 7 to feed in a backward direction opposite to a direction of ejecting the thermal tape 42 into an outlet until a printing start area of the thermal tape 42 reaches a head position of the thermal head 8. The thermal head 8 performs printing on the thermal tape 42 after the printing start area reaches the head position by the feeding of the thermal tape 42 in the backward direction.

9 Claims, 11 Drawing Sheets

PRINTING DEVICE, CONTROL METHOD, AND RECORDING MEDIUM

CROSS-REFERENCE TO RELATED APPLICATION

This application is based upon and claims the benefit of priority from the prior Japanese Patent Application No. 2018-053772, filed Mar. 22, 2018, the entire contents of which are incorporated herein by reference.

BACKGROUND

1. Technical Field

This technical field relates to a printing device, a control method, and a recording medium.

2. Description of the Related Art

There are known label printers for printing characters, figures, and the like on a tape member including a base material and a separator, and cutting the tape member after being printed to create a label. The label printers include a label printer having a half cutter in addition to a full cutter for fully cutting the tape member. The label printer including the half cutter is described, for example, in Japanese Patent Application Laid-Open No. 2004-216692, which can create a label with the base material easy to peel off from the separator by performing a half cut near the tip of the tape member.

Depending on the print length, the tape member may reach a position of performing the half cut in the middle of printing. In such a case, when the tape member reaches the position of performing the half cut, the conventional label printer performs such control that both printing and feeding are stopped to perform the half cut, and the printing and the feeding are then resumed.

However, when the feeding is stopped in the middle of printing, a slight deviation occurs in the printing position, and as a result, there is a danger that the printing quality will be deteriorated due to a printing omission, uneven printing, or the like.

SUMMARY

According to one aspect of the present invention, there is provided a printing device including: a control unit; a feeding roller which feeds a tape member; a print head which performs printing on the tape member; a half cutter which performs a half cut on the tape member; and a control unit which controls the feeding roller to feed the tape member in a backward direction opposite to a direction of ejecting the tape member into an outlet until a printing start area of the tape member reaches a head position of the print head after the half cut is performed, wherein the control unit causes the print head to perform printing on the tape member after the printing start area reaches the head position by the feeding of the tape member in the backward direction.

According to another aspect of the present invention, there is provided a printing device including: a control unit; a feeding roller which feeds a tape member; a print head which performs printing on the tape member; a half cutter which performs a half cut on the tape member; and a control unit which controls the feeding roller to feed the tape member in a backward direction opposite to a direction of ejecting the tape member into an outlet until a half-cut position of the tape member reaches a cutter position of the half cutter after the printing is performed, wherein the control unit causes the half cutter to perform the half cut on the tape member after the half-cut position reaches the cutter position by the feeding of the tape member in the backward direction.

According to still another aspect of the present invention, there is provided a printing device including: a control unit; a feeding roller which feeds a tape member; a print head which performs printing on the tape member; and a half cutter which performs a half cut on the tape member, wherein after either one of the printing and the half cut is performed, the control unit causes the feeding roller to feed the tape member in a backward direction opposite to a direction of ejecting the tape member into an outlet until the tape member reaches a position at which the other one of the printing and the half cut is performed.

According to yet another aspect of the present invention, there is provided a control method implemented by a printing device including a control unit, the method including the steps of: performing a half cut on a tape member; feeding the tape member in a backward direction opposite to a direction of ejecting the tape member into an outlet until a printing start area of the tape member reaches a position of a print head of the printing device after the half cut is performed; and performing printing on the tape member after the printing start area reaches the position of the print head by the feeding of the tape member in the backward direction.

According to yet another aspect of the present invention, there is provided a control method implemented by a printing device including a control unit, the method including the steps of: performing printing on a tape member; feeding the tape member in a backward direction opposite to a direction of ejecting the tape member into an outlet until a half-cut position of the tape member reaches a cutter position of a half cutter included in the printing device after the printing is performed; and performing a half cut on the tape member when the half-cut position reaches the cutter position by the feeding of the tape member in the backward direction.

According to still another aspect of the present invention, there is provided a non-transitory recording medium recording a computer readable program executed by a printing device including a control unit, the program causing the control unit to execute: a process of causing a feeding roller of the printing device to feed a tape member in a backward direction opposite to a direction of ejecting the tape member into an outlet until a printing start area of the tape member reaches the position of a print head of the printing device after a half cutter of the printing device performs a half cut on the tape member; and a process of performing printing on the tape member when the printing start area reaches the position of the print head by the feeding of the tape member in the backward direction.

According to a further aspect of the present invention, there is provided a non-transitory recording medium recording a computer readable program executed by a printing device including a control unit, the program causing the control unit to execute: a process of causing a feeding roller of the printing device to feed a tape member in a backward direction opposite to a direction of ejecting the tape member into an outlet until a half-cut position of the tape member reaches a cutter position of a half cutter included in the printing device after a print head of the printing device performs printing on the tape member; and a process of causing the half cutter to half cut the tape member when the half-cut position reaches the cutter position by the feeding of the tape member in the backward direction.

BRIEF DESCRIPTION OF THE SEVERAL VIEWS OF THE DRAWING

For a better understanding of this application, reference is made to the following detailed description considered in conjunction with the accompanying drawings.

DETAILED DESCRIPTION

Figure 1:
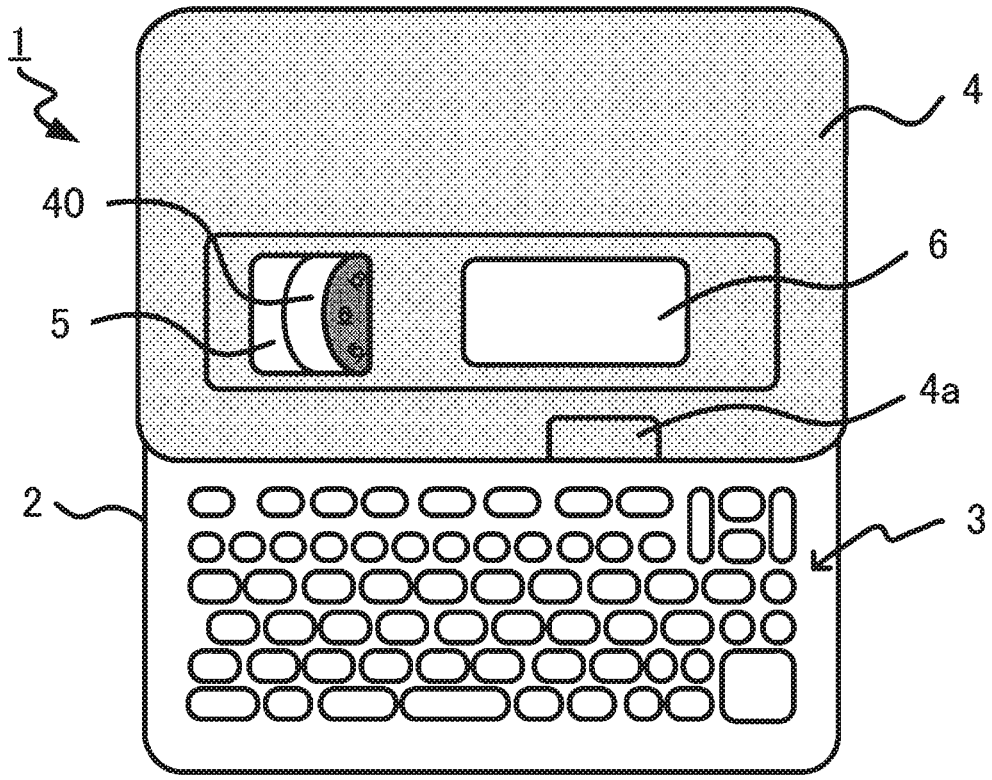
FIG. 1 is a plan view of a printing device 1 in a state where a cover 4 is closed.
Figure 2:
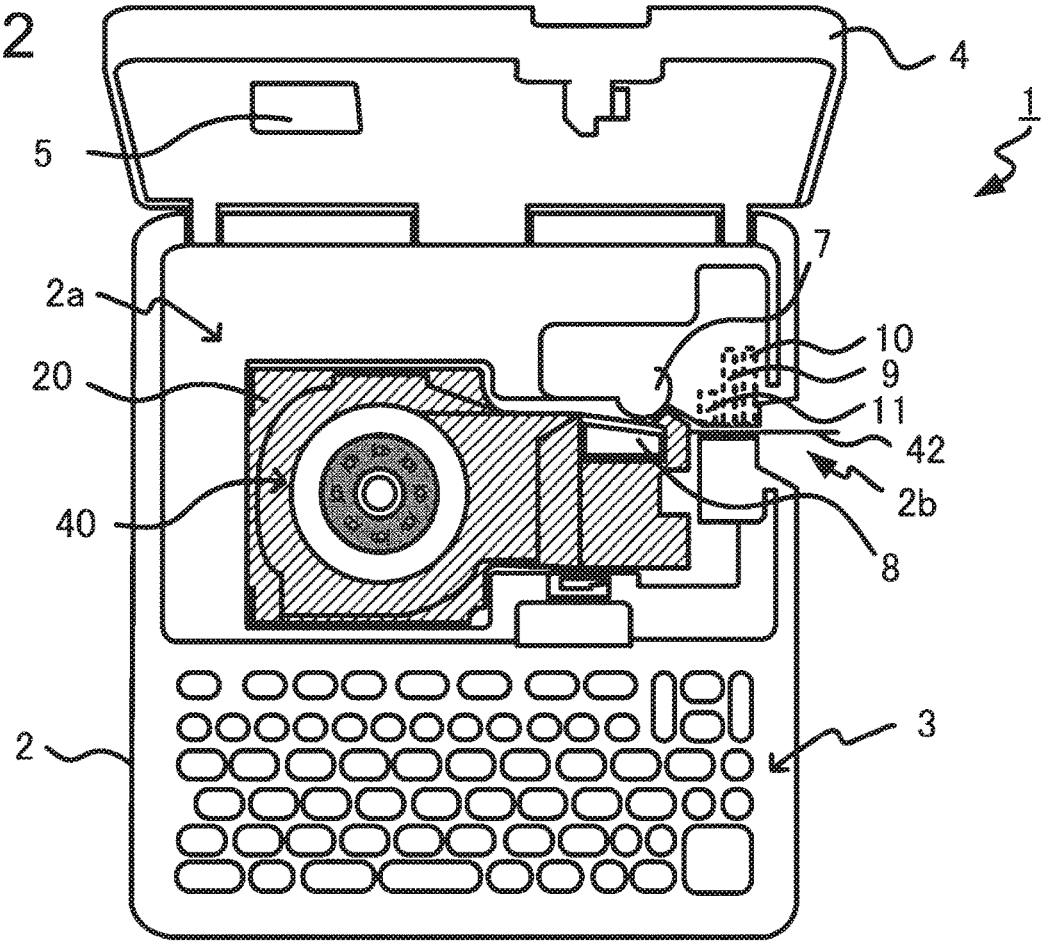
FIG. 2 is a plan view of the printing device 1 in a state where the cover 4 is open.

FIG. 1 is a plan view of a printing device 1 in a state where a cover 4 is closed. FIG. 2 is a plan view of the printing device 1 in a state where the cover 4 is open. The structure of the printing device 1 will be described below with reference to FIG. 1 and FIG. 2.

The printing device 1 is a label printer which performs printing on a thermal tape 42 contained in a print medium 40. A thermal label printer using the thermal tape 42 is described below by way of example, but the printing method is not particularly limited. The printing device 1 may be a thermal-transfer label printer using an ink ribbon. Further, the printing device 1 may be an ink-jet printer, a laser printer, or the like. Further, the printing device 1 may perform printing in the form of single-path (one-path) routing or multipath routing (scanning).

As illustrated in FIG. 1, the printing device 1 includes a device housing 2, an input unit 3, the openable and closable cover 4, a window 5, and a display unit 6. Further, though not illustrated, a power cord connection terminal, an external device connection terminal, a storage media insertion slot, and the like are provided in the device housing 2.

The input unit 3 is provided on the upper face of the device housing 2. The input unit 3 includes various keys such as input keys, a cross key, a conversion key, and an enter key. The cover 4 is arranged above the device housing 2. A user can press a button 4*a* down to release a lock mechanism in order to open the cover 4 as illustrated in FIG. 2. The window 5 is formed in the cover 4 so that the user can visually confirm whether the print medium 40 is housed in the printing device 1 even in the closed state of the cover 4. The cover 4 also has the display unit 6.

The display unit 6 is, for example, a liquid crystal display, an organic EL (electro-luminescence) display, or the like. The display unit 6 displays characters and the like corresponding to input from the input unit 3, selection menus for various settings, messages related to various processing, and the like. Note that the display unit 6 may be a display with a touch panel thereon, or the display unit 6 may function as part of the input unit 3.

As illustrated in FIG. 2, the device housing 2 includes, below the cover 4, a medium adapter storage part 2*a*, a platen roller 7, and a thermal head 8. In the medium adapter storage part 2*a*, a medium adapter 20 with the print medium 40 contained therein is stored. Further, the device housing 2 includes a full cutter 9, a half cutter 10, and a photo sensor 11 between an outlet 2*b*, from which the thermal tape 42 is ejected, and the thermal head 8. The half cutter 10, the full cutter 9, and the photo sensor 11 are arranged in this order as seen from the side of the outlet 2*b*. The medium adapter 20 and the print medium 40 will be described later.

The platen roller 7 is a feeding roller which feeds the thermal tape 42. The platen roller 7 rotates by the rotation of a feeding motor 32 (see FIG. 6). The feeding motor 32 is, for example, a stepping motor, a direct-current (DC) motor, or the like. The platen roller 7 rotates while sandwiching the thermal tape 42, sent out from the medium adapter 20, with the thermal head 8 to feed the thermal tape 42 in the feeding direction.

The thermal head 8 is a print head which performs printing on the thermal tape 42. The thermal head 8 has multiple heating elements 8*a* (see FIG. 6) in a main scanning direction perpendicular to the feeding direction of the thermal tape 42 to heat the thermal tape 42 using the heating elements 8*a* so as to perform printing one line by one line.

The full cutter 9 is a cutting mechanism for performing a full cut to cut the thermal tape 42 so as to create a tape piece. Note that the full cut means operation for cutting all layers that compose the thermal tape 42 along the width direction of the thermal tape 42.

The half cutter 10 is a cutting mechanism for performing a half cut to make a cut in the thermal tape 42. Note that the half cut means operation for cutting layers except a separator L1 (see FIG. 5) to be described later in the thermal tape 42 along the width direction thereof.

The photo sensor 11 is a sensor arranged on the feeding path of the thermal tape 42 to detect the tip of the thermal tape 42. The photo sensor 11 includes, for example, a light-emitting element and a light-receiving element. The light-emitting element is, for example, a light-emitting diode, and the light-receiving element is, for example, a photodiode. The photo sensor 11 has the light-receiving element detect the reflected light emitted from the light-emitting element to output a signal to a control circuit 12 (see FIG. 6) to be described later. The control circuit 12 detects the tip of the thermal tape 42, for example, based on a change in the amount of reflected light detected by the light-receiving element. Note that the photo sensor 11 is not limited to a photo reflector which detects the reflected light emitted from the light-emitting element. The photo sensor 11 may be a photo interrupter in which the light-emitting element and the light-receiving element are arranged opposite to each other.

Figure 3:
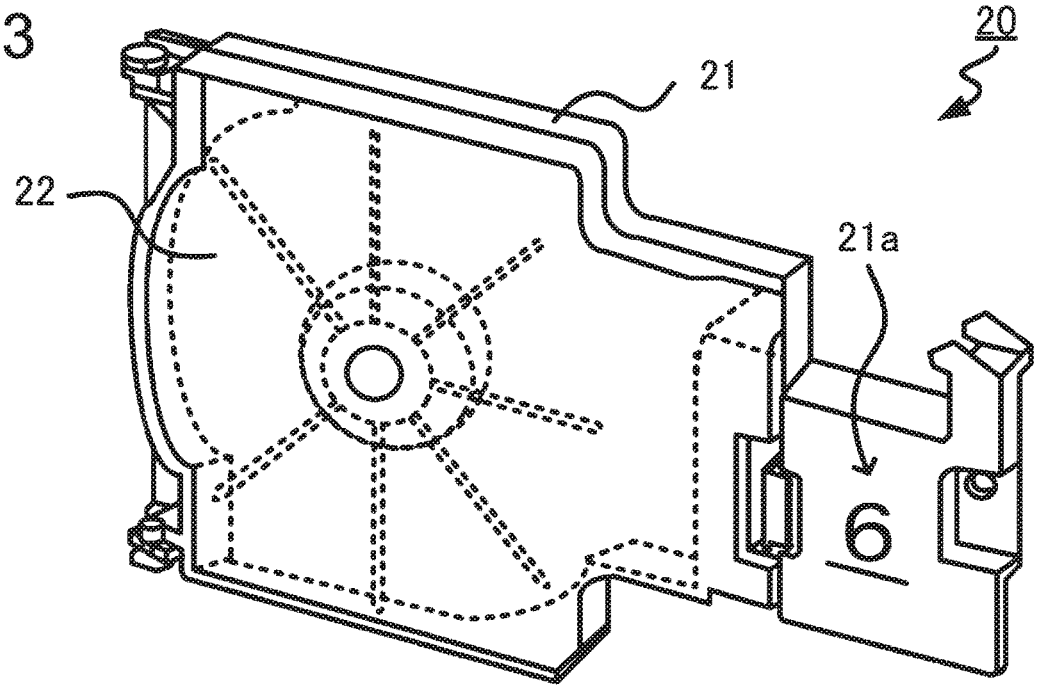
FIG. 3 is a perspective view of a medium adapter 20.
Figure 4:
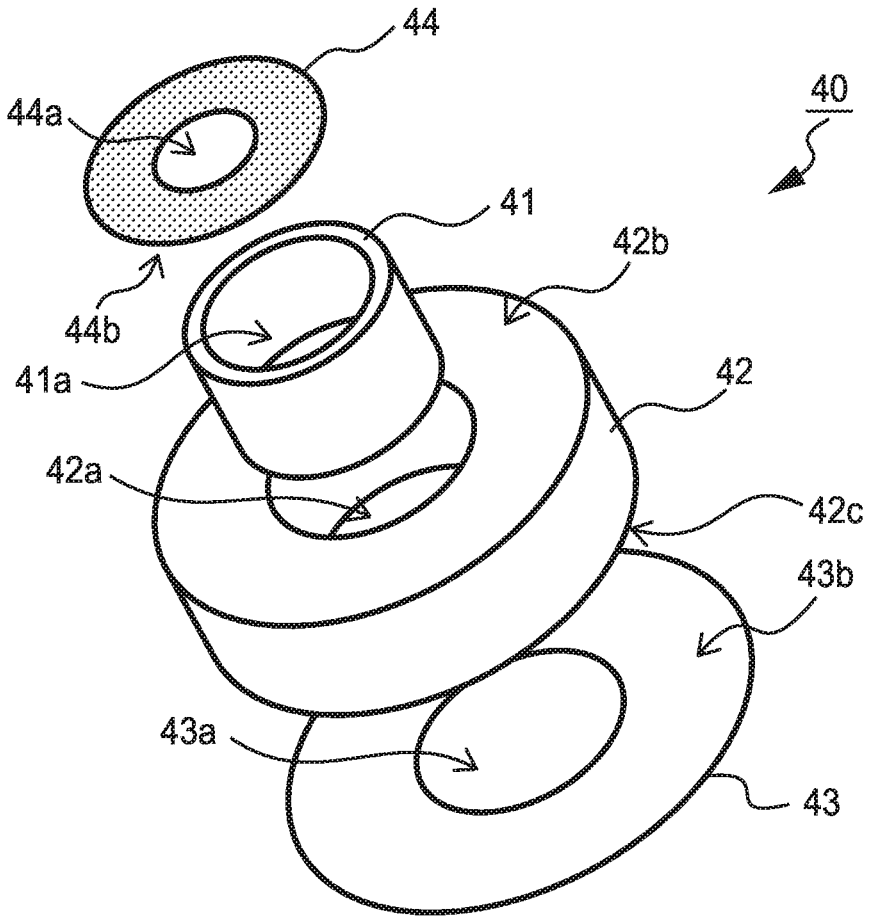
FIG. 4 is a diagram for describing the structure of a print medium 40.
Figure 5:
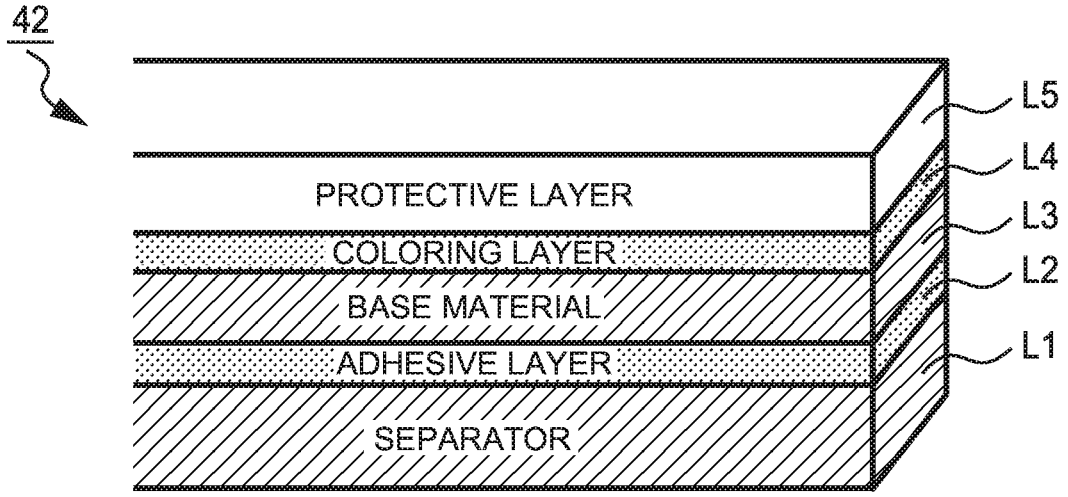
FIG. 5 is a diagram for describing the structure of a thermal tape 42.

FIG. 3 is a perspective view of the medium adapter 20. FIG. 4 is a diagram for describing the structure of the print medium 40. FIG. 5 is a diagram for describing the structure of the thermal tape 42. The structure of the medium adapter 20 and the structure of the print medium 40 will be described below with reference to FIG. 3 to FIG. 5.

The medium adapter 20 is a medium adapter for storing the print medium 40 to store the print medium 40 in such a manner that the user can replace the print medium 40. In other words, the medium adapter 20 is designed on the assumption that the user takes the print medium 40 in and out of the medium adapter 20.

As illustrated in FIG. 3, the medium adapter 20 includes an adapter body 21 and an adapter cover 22 attached to the adapter body 21 openably and closably. The print medium 40 is stored in the internal space of the medium adapter 20 partitioned by the adapter body 21 and the adapter cover 22.

Further, the medium adapter 20 is designed to fit the tape width of the thermal tape 42 contained in the print medium 40. The tape width of the thermal tape 42 to be stored in the medium adapter 20 is indicated in an area 21*a* of the adapter body 21. In this example, the medium adapter 20 is a medium adapter for a tape with a tape width of 6 mm.

Since the medium adapter 20 with the print medium 40 stored therein is housed in the printing device 1, the print medium 40 is housed in the printing device 1. Note that the printing device 1 can house medium adapters corresponding to different tape widths. Specifically, for example, the printing device 1 can house, in addition to the medium adapter 20 for 6 mm tape illustrated in FIG. 3, a medium adapter for 9 mm tape, a medium adapter for 12 mm tape, a medium adapter for 18 mm tape, and the like.

As illustrated in FIG. 4, the print medium 40 includes a paper tube 41, the thermal tape 42, a loosening prevention sheet 43, and an attention sheet 44.

The paper tube 41 is a cylindrical member around which the thermal tape 42 is wound and which has a hollow portion 41*a*. The thermal tape 42 is a printing tape member wound in the longitudinal direction and formed into a cylindrical shape, which is wound to form a hollow portion 42*a*. The loosening prevention sheet 43 is an adhesive sheet stuck on one (side face 42*c*) of the side faces of the cylindrical shape of the thermal tape 42. The attention sheet 44 is an adhesive sheet stuck on the other (side face 42*b*) of the cylindrical shape of the thermal tape 42.

The paper tube 41 is provided in the hollow portion 42*a* of the thermal tape 42. The paper tube 41 is a cylindrical member structured such that a projecting portion formed on the bottom face of the adapter body 21 is inserted in the hollow portion 41*a* of the paper tube 41 in a state where the print medium 40 is stored in the medium adapter 20. The paper tube 41 is useful to rotate the print medium 40 smoothly inside the medium adapter 20 without damaging the print medium 40 while the thermal tape 42 is being fed by the platen roller 7.

For example, the thermal tape 42 has a five-layer structure as illustrated in FIG. 5. In other words, the separator L1, an adhesive layer L2, a base material L3, a coloring layer L4, and a protective layer L5 are laminated in this order. The separator L1 is stuck peelably to the base material L3 to cover the adhesive layer L2. The material of the separator L1 is, for example, paper. However, the material is not limited to paper, and it may be PET (polyethylene terephthalate). The adhesive layer L2 is an adhesive material applied to the base material L3. The material of the base material L3 is, for example, colored PET. The coloring layer L4 is a heat-sensitive coloring layer which develops color by the application of heat energy. The material of the protective layer L5 is, for example, transparent PET.

The structure of the thermal tape 42 is not limited to the structure illustrated in FIG. 5. For example, the thermal tape 42 may be such that the coloring layer L4 is exposed without the protective layer L5.

In the state of being wound around the paper tube 41, the thermal tape 42 has a shape corresponding to the shape of the paper tube 41. In other words, the thermal tape 42 has a cylindrical shape, and both side faces (the side face 42*b* and the side face 42*c*) have an annular shape.

The loosening prevention sheet 43 is an adhesive sheet to maintain the shape of the thermal tape 42. The thermal tape 42 can expand by changes in humidity. However, since the loosening prevention sheet 43 is applied to the side face 42*c* of the thermal tape 42, shape variations of the thermal tape 42 due to expansion, that is, loosening of the thermal tape 42 can be suppressed. Further, even when an impact is exerted on the thermal tape 42 due to dropping of the print medium 40 or the like, the loosening prevention sheet 43 can suppress the shape variations.

The loosening prevention sheet 43 has an opening section 43*a* and an adhesive face 43*b*. The opening section 43*a* has a size equal to the hollow portion 41*a* of the paper tube 41 or larger than the hollow portion 41*a* of the paper tube 41. The loosening prevention sheet 43 is stuck on the side face 42*c* in such a manner that the opening section 43*a* faces the hollow portion 42*a* of the thermal tape 42. It is also desired that the loosening prevention sheet 43 should have such a size as to cover the side face 42*c* of the thermal tape 42. In other words, it is desired that the loosening prevention sheet 43 should be larger than the side face 42*c*. Thus, since the whole thermal tape 42 can be held on the adhesive face, the shape can be maintained more definitely.

Further, it is desired that the shape of the loosening prevention sheet 43 should be similar to the shape of the side face 42*c*. In other words, it is desired that, when the side face 42*c* has an annular shape, the loosening prevention sheet 43 should also have an annular shape. Thus, since such an area as not to contribute to maintaining the shape of the thermal tape 42 can be reduced, the size of the loosening prevention sheet 43 can be reduced. Further, since the exposure of the adhesive face is also reduced, the adhesion of dust, dirt, and the like to the loosening prevention sheet 43 can also be reduced.

The attention sheet 44 is an adhesive sheet indicative of the type of print medium 40 (more strictly, the type of thermal tape 42). There are various types of thermal tapes 42, depending on the difference in tape width and the color difference in surface to be printed. Since information for specifying the type is included in the attention sheet 44, the user can readily identify the type of print medium 40 by applying the attention sheet 44 to the side face 42*b* of the thermal tape 42.

The attention sheet 44 has an opening section 44*a* and an adhesive face 44*b*. The opening section 44*a* is smaller than the hollow portion 42*a* of the thermal tape 42, and further smaller than the hollow portion 41*a* of the paper tube 41. The attention sheet 44 is applied to the side face 42*b* in such a manner that the opening section 44*a* faces the hollow portion 42*a* of the thermal tape 42. It is desired that the attention sheet 44 should be smaller than the side face 42*b* of the thermal tape 42 at least before the start of use of the print medium 40, for example, at the time of sale of the print medium 40. More specifically, it is desired that the area of the attention sheet 44 should be smaller than the area of the side face 42*b* of the thermal tape 42. Thus, since an area covered with the attention sheet 44 on the side face 42*b* of the thermal tape 42 is reduced, it is easy to check the remaining amount of the thermal tape 42.

The material of the paper tube 41, the loosening prevention sheet 43, and the attention sheet 44 is not limited to paper. However, if these members are made of paper, the used print medium 40 after the thermal tape 42 is used up can be thrown away as a burnable waste. Therefore, it is desired that the material of the paper tube 41, the loosening prevention sheet 43, and the attention sheet 44 should be paper.

Figure 6:
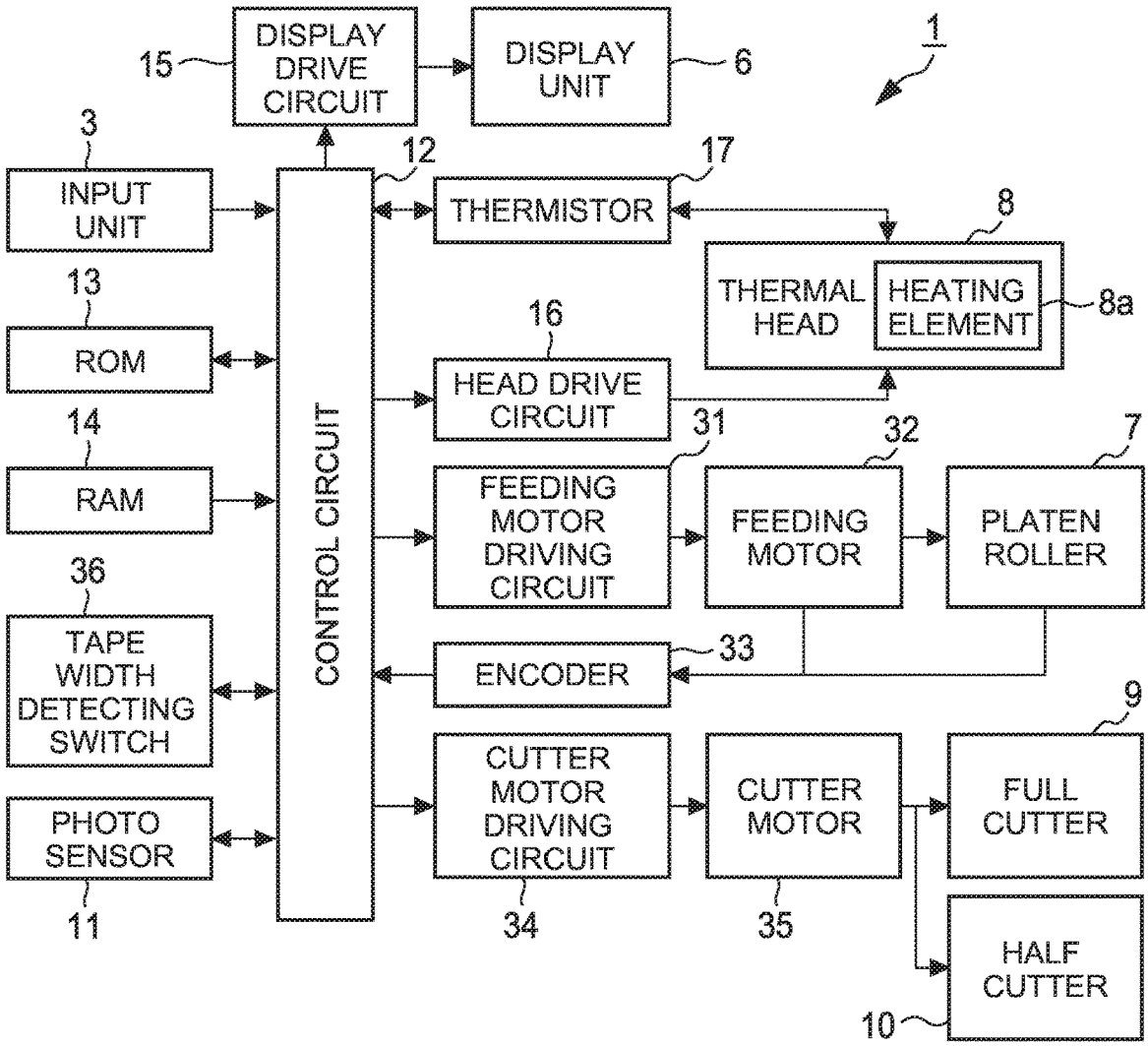
FIG. 6 is a block diagram illustrating the hardware configuration of the printing device 1.

FIG. 6 is a block diagram illustrating the hardware configuration of the printing device 1. As illustrated in FIG. 6, the printing device 1 includes, in addition to the components described above, the control circuit 12, a ROM (Read Only Memory) 13, a RAM (Random Access Memory) 14, a display drive circuit 15, a head drive circuit 16, a thermistor 17, a feeding motor driving circuit 31, the feeding motor 32, an encoder 33, a cutter motor driving circuit 34, a cutter motor 35, and a tape width detecting switch 36.

The control circuit 12 is a control unit including a processor such as a CPU (Central Processing Unit). The control circuit 12 expands, in the RAM 14, and executes a program stored in the ROM 13 to control the operation of each component of the printing device 1.

The program and various data (fonts and the like) necessary to execute the program are stored in the ROM 13. The RAM 14 is a working memory used to execute the program. Note that computer-readable recording media for storing the program and data used for processing in the printing device 1 include physical (non-transitory) recording media such as the ROM 13 and the RAM 14.

The display drive circuit 15 is a liquid crystal display driver circuit or an organic EL display driver circuit. The display drive circuit 15 controls the display unit 6 based on display data stored in the RAM 14.

The head drive circuit 16 controls the energization of the heating elements 8*a* in the thermal head 8 based on print data and a control signal under the control of the control circuit 12. The thermal head 8 is a print head having multiple heating elements 8*a* arrayed in the main scanning direction. The thermal head 8 heats the thermal tape 42 using the heating elements 8*a* to perform printing one line by one line. The thermistor 17 is embedded in the thermal head 8. The thermistor 17 measures the temperature of the thermal head 8.

The feeding motor driving circuit 31 drives the feeding motor 32 under the control of the control circuit 12. The feeding motor 32 may be, for example, a stepping motor or a direct-current (DC) motor. The feeding motor 32 rotates the platen roller 7. Note that the feeding motor 32 rotates, under the control of the feeding motor driving circuit 31, not only in the forward direction as a direction to send out the thermal tape 42 but also in the backward direction as a direction to rewind the thermal tape 42.

The platen roller 7 is a feeding roller which rotates by the driving force of the feeding motor 32 to feed the thermal tape 42 along the longitudinal direction (sub-scanning direction, feeding direction) of the thermal tape 42. When the feeding motor 32 rotates in the forward direction, the platen roller 7 sends out the thermal tape 42 from the medium adapter 20, while when the feeding motor 32 rotates in the backward direction, the platen roller 7 rewinds the thermal tape 42 being sent out from the medium adapter 20.

In other words, the control circuit 12 in the printing device 1 is a control unit which controls the feeding motor 32 through the feeding motor driving circuit 31 to control the platen roller 7.

The encoder 33 outputs, to the control circuit 12, a signal according to the driving amount (rotation amount) of the feeding motor 32 or the platen roller 7. The encoder 33 may be provided to the rotating shaft of the feeding motor 32, or may be provided to the rotating shaft of the platen roller 7. The control circuit 12 can specify the feeding amount of the thermal tape 42 based on the signal from the encoder 33.

When the feeding motor 32 is a stepping motor, the control circuit 12 may specify the feeding amount based on a signal (input pulse number) input to the feeding motor driving circuit 31 that drives the feeding motor 32. Thus, when the feeding motor 32 is the stepping motor, the encoder 33 may be omitted and the control circuit 12 may specify the feeding amount based on the signal (input pulse number) input to the feeding motor driving circuit 31.

The cutter motor driving circuit 34 drives the cutter motor 35 under the control of the control circuit 12. The full cutter 9 is operated by the power of the cutter motor 35 to cut the thermal tape 42 so as to create a tape piece. The half cutter 10 is operated by the power of the cutter motor 35 to cut layers (L2 to L4) except the separator L1 in the thermal tape 42.

The tape width detecting switch 36 is a switch provided in the medium adapter storage part 2*a* to detect the width of the thermal tape 42 stored in the medium adapter 20 based on the shape of the medium adapter 20. Plural tape width detecting switches 36 are provided in the medium adapter storage part 2*a*. Each of medium adapters 20, which corresponds to a different tape width, is structured to press down a different combination of plural tape width detecting switches 36, respectively. Thus, the control circuit 12 specifies each type of medium adapter 20 from the combination of tape width detecting switches 36 pressed down to detect the width (tape width) of the thermal tape 42 stored in the medium adapter 20.

First Embodiment

Figure 7:
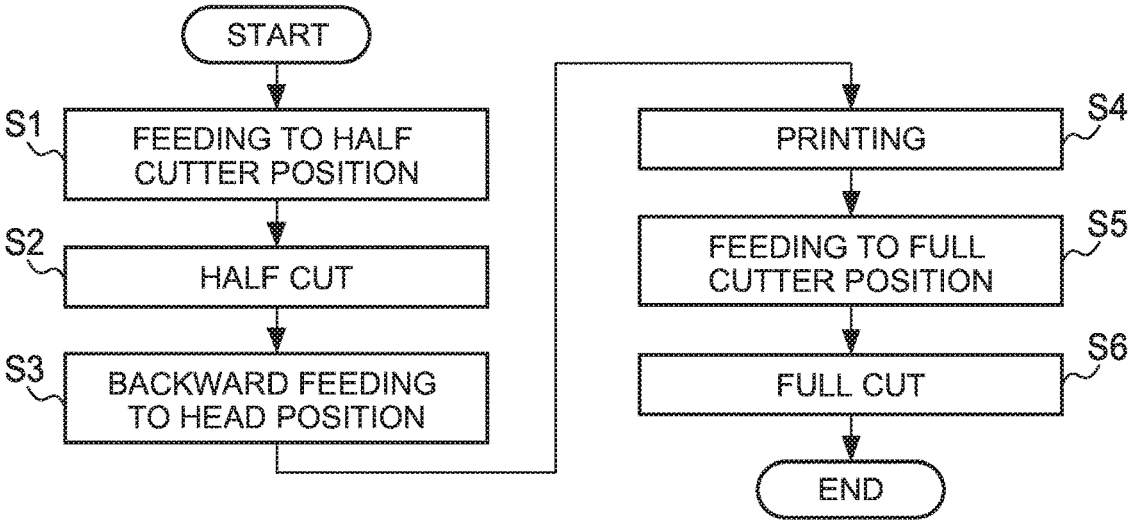
FIG. 7 is an example of a flowchart of processing according to a first embodiment.
Figure 8:
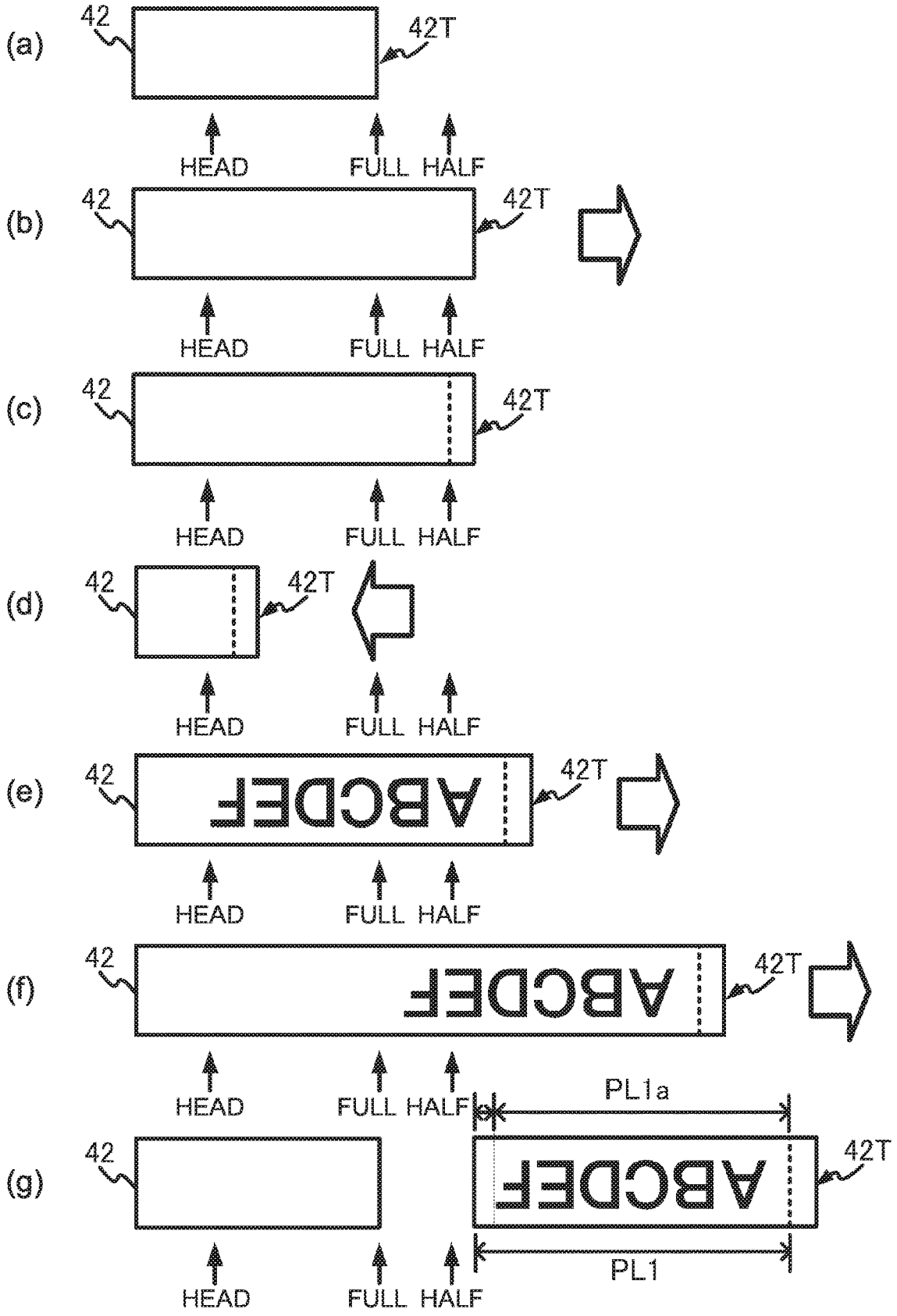
FIG. 8 is a diagram for describing a state of the thermal tape 42 in each processing step illustrated in FIG. 7.

FIG. 7 is an example of a flowchart of processing performed by the printing device 1 according to a first embodiment. FIG. 8 is a diagram for describing a state of the thermal tape 42 in each processing step illustrated in FIG. 7. The processing performed by the printing device 1 will be specifically described below with reference to FIG. 7 and FIG. 8.

In the printing device 1, when a print command is input, the control circuit 12 starts the processing illustrated in FIG. 7, for example, by reading a program stored in the ROM 13 into the RAM 14 and executing the program. FIG. 8(*a*) illustrates a state of the thermal tape 42 at the start of the processing illustrated in FIG. 7. In this state, a tip 42T of the thermal tape 42 is located at a cutter position of the full cutter 9 (hereinafter called the full cutter position).

In FIG. 8, the term "FULL" indicates the full cutter position, the term "HALF" indicates a cutter position of the half cutter 10 (hereinafter called the half cutter position), and the term "HEAD" indicates a head position of the thermal head 8.

The control circuit 12 first causes the platen roller 7 to feed the thermal tape 42 until a half-cut position of the thermal tape 42 reaches the half cutter position (step S1). The half-cut position means the position of a section at which a half cut is performed in an area of the thermal tape 42. When the half cut is performed to make it easy to peel off the base material L3 from the separator L1, the half-cut position is a position a predetermined distance from the tip 42T of the thermal tape 42. This predetermined distance is, for example, about a few mm.

In the printing device 1, as illustrated in FIG. 2, the half cutter 10 is located on the downstream side of the full cutter 9 in the feeding direction. Therefore, in step S1, the control circuit 12 controls the feeding motor driving circuit 31 to rotate the platen roller 7 forward so as to feed the half-cut position to the half cutter position. In other words, the control circuit 12 feeds the thermal tape 42 in the forward direction until the half-cut position of the thermal tape 42 reaches the cutter position of the half cutter 10 before performing the half cut. FIG. 8(*b*) illustrates a state of the thermal tape 42 upon completion of feeding in step S1.

When the feeding is completed, the control circuit 12 controls the cutter motor driving circuit 34 to cause the half cutter 10 to perform a half cut on the thermal tape 42 (step S2). FIG. 8(*c*) illustrates a state of the thermal tape 42 upon completion of the half cut in step S2.

When the half cut is performed, the control circuit 12 then causes the platen roller 7 to feed the thermal tape 42 backward until a printing start area of the thermal tape 42 reaches the head position of the thermal head 8 (step S3). In other words, the control circuit 12 controls the platen roller 7 to feed the thermal tape 42 in a direction opposite to a direction of ejecting the thermal tape into the outlet until the printing start area reaches the head position. The printing start area is a section closest to the tip 42T of the thermal tape 42 in a printing area of the thermal tape 42. Further, the printing area is a section in which the thermal head 8 performs printing in the area of the thermal tape 42. A section between the printing start area and the tip 42T of the thermal tape 42 is a section in which no printing is performed. A section between the printing start area and the half-cut position is a section as a label margin.

In the state illustrated in FIG. 8(*c*), where the half-cut position is at the half cutter position, the printing start area is located at a position on the downstream side of the thermal head 8 in the feeding direction. Therefore, in step S3, the control circuit 12 controls the feeding motor driving circuit 31 to rotate the platen roller 7 backward so as to feed the printing start area to the head position. FIG. 8(*d*) illustrates a state of the thermal tape 42 upon completion of feeding in step S3.

When the feeding is completed, the control circuit 12 performs printing control (step S4). Here, the control circuit 12 controls the feeding motor driving circuit 31 and the head drive circuit 16 to cause the thermal head 8 to perform printing based on print data while rotating the platen roller 7 forward to feed the thermal tape 42. In other words, the thermal head 8 performs printing on the thermal tape 42 after the printing start area reaches the head position by the feeding of the thermal tape 42 in the backward direction. FIG. 8(*e*) illustrates a state of the thermal tape 42 upon completion of printing in step S4.

When the printing is performed, the control circuit 12 then causes the platen roller 7 to feed the thermal tape 42 until a full-cut position of the thermal tape 42 reaches the full cutter position (step S5). The full-cut position means the position of a section at which a full cut is performed in the area of the thermal tape 42. The full-cut position is, for example, a position apart from the end of the printing area by a length corresponding to the label margin.

In the state illustrated in FIG. 8(*e*), where the printing is completed, the full-cut position is located on the upstream side of the full cutter 9 in the feeding direction. Therefore, in step S5, the control circuit 12 controls the feeding motor driving circuit 31 to rotate the platen roller 7 forward so as to feed the full-cut position to the full cutter position. FIG. 8(*f*) illustrates a state of the thermal tape 42 upon completion of feeding in step S5.

When the feeding is completed, the control circuit 12 controls the cutter motor driving circuit 34 to cause the full cutter 9 to perform a full cut on the thermal tape 42 (step S6). Thus, the thermal tape 42 is cut, and hence a label as a piece of tape separated from the thermal tape 42 as a continuous medium is created. FIG. 8(*g*) illustrates a state of the thermal tape 42 upon completion of the full cut in step S6.

As described above, in the processing illustrated in FIG. 7, since the half cut is first performed before the printing is performed, the printing can be performed without stopping the feeding in the middle of printing. Thus, according to the printing device 1, the processing illustrated in FIG. 7 can be performed to prevent the deterioration of print quality due to the half cut.

Further, in the processing illustrated in FIG. 7, the platen roller 7 is rotated backward after the half cut until the printing start area reaches the head position. This can lead to adjusting the margin amount at the tip of a label to be created. Thus, according to the printing device 1, the processing illustrated in FIG. 7 can be performed to prevent the creation of a label having an excessive margin, and hence prevent a wasteful use of the thermal tape 42.

In FIG. 8, although the description is made by taking, as an example, a case where a print length PL1 is sufficiently longer than the distance between the thermal head 8 and the half cutter 10, the effect of preventing the deterioration of print quality obtained by the processing illustrated in FIG. 7 is independent of the print length PL1. The printing device 1 can perform the processing illustrated in FIG. 7 to achieve a high level of print quality regardless of whether the print length is short or long.

Further, although the description is made by taking, as an example, a case where the full cutter 9 is located on the upstream side of the half cutter 10 in the feeding direction, the positional relationship between the full cutter 9 and the half cutter 10 is not limited to this example. The half cutter 10 may be located on the upstream side of the full cutter 9 in the feeding direction. In this case, in step S1 illustrated in FIG. 7, the control circuit 12 may control the feeding motor driving circuit 31 to rotate the platen roller 7 backward so as to feed the half-cut position to the half cutter position.

Second Embodiment

Figure 9:
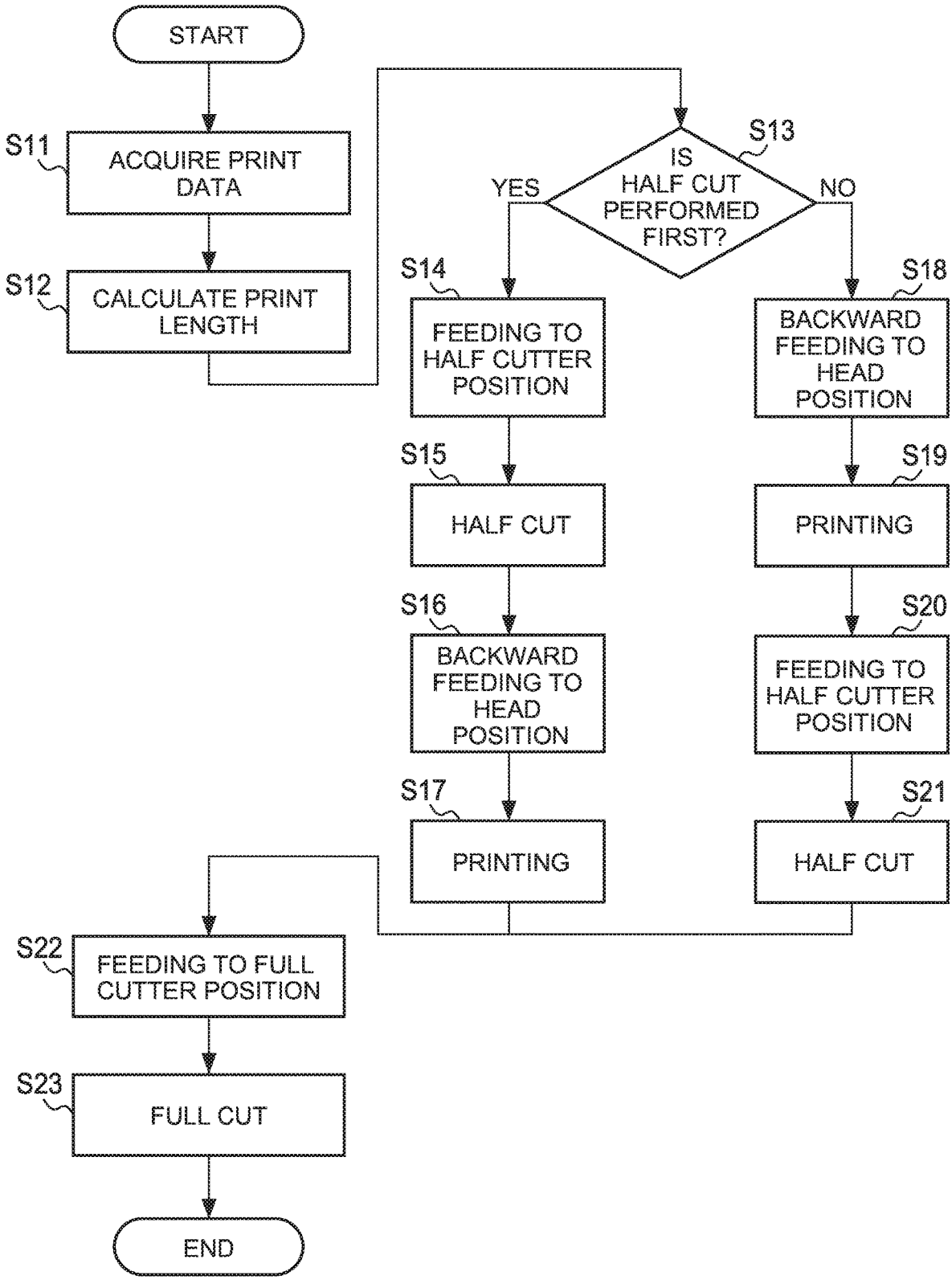
FIG. 9 is an example of a flowchart of processing according to a second embodiment.
Figure 10:
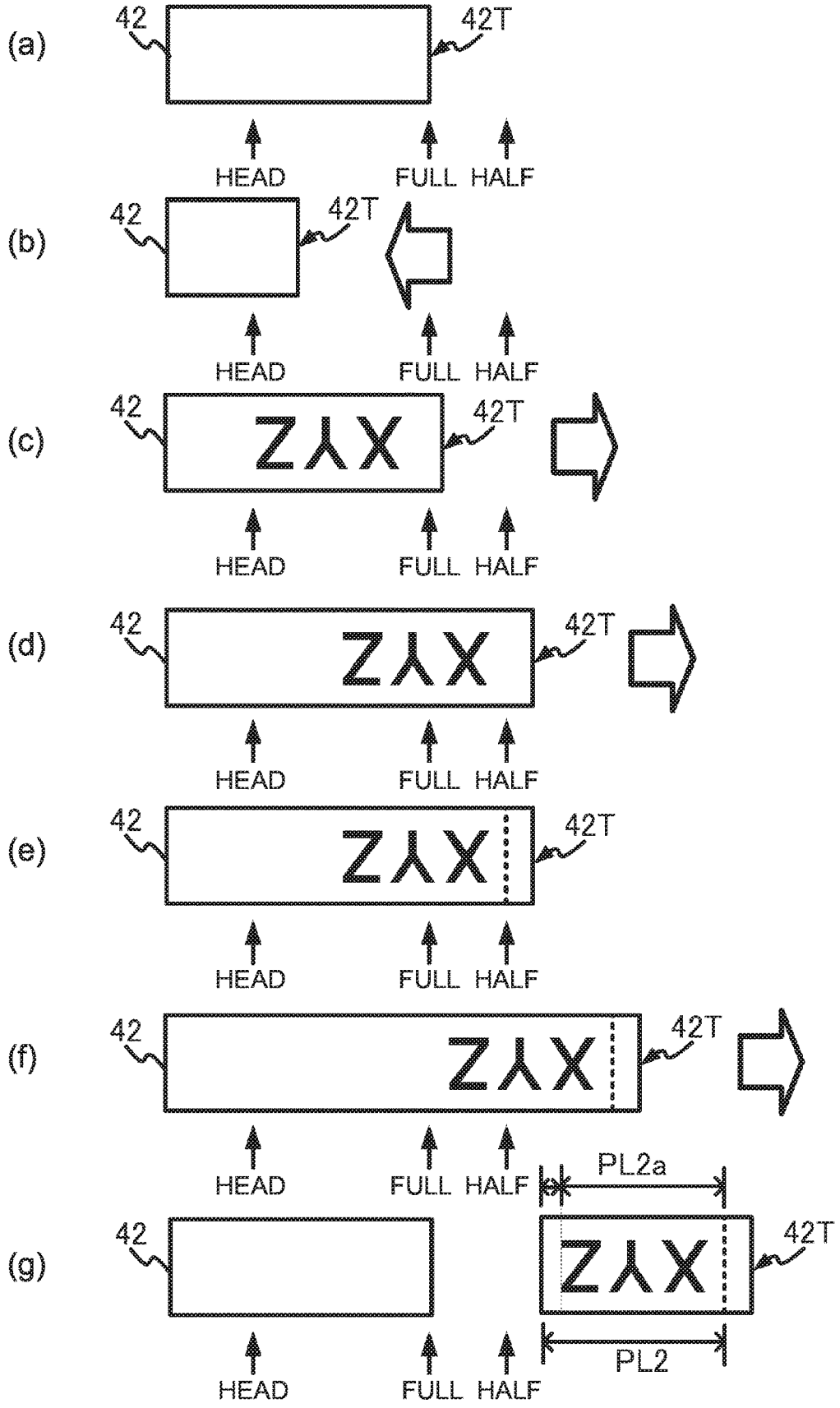
FIG. 10 is a diagram for describing a state of the thermal tape 42 in each processing step illustrated in FIG. 9.

FIG. 9 is an example of a flowchart of processing according to a second embodiment. FIG. 10 is a diagram for describing a state of the thermal tape 42 in each processing step illustrated in FIG. 9. The processing illustrated in FIG. 9 is different from the processing illustrated in FIG. 7 in that it is determined, based on print data, which of printing and a half cut is performed first. The processing performed by the printing device 1 will be specifically described below with reference to FIG. 8 to FIG. 10.

In the printing device 1, when a print command is input, the control circuit 12 starts the processing illustrated in FIG. 9, for example, by reading a program stored in the ROM 13 into the RAM 14 and executing the program. Like FIG. 8(*a*), FIG. 10(*a*) illustrates a state of the thermal tape 42 at the start of the processing illustrated in FIG. 9. In this state, the tip 42T of the thermal tape 42 is located at the full cutter position.

The control circuit 12 first acquires print data (step S11), and calculates a print length based on the print data (step S12).

Note that the print length is the length of a label created by the printing device 1, and more specifically, a length as a product used by being peeled off from the separator L1 in a tape piece. Suppose that the half cut is performed near the tip of the tape piece. In this case, for example, as illustrated in FIG. 8(*g*) and FIG. 10(*g*), the distance between the half-cut position and the full-cut position is the print length (print length PL1, print length PL2).

When calculating the print length, the control circuit 12 determines, based on the calculated print length, whether the half cut is performed first (step S13). When printing is started from the printing start area, whether the half-cut position reaches the half cutter position during printing is dependent on the print length. When it can be determined from the print length that the half-cut position does not reach the half cutter position, printing is not stopped during printing even if printing is performed first. Therefore, in step S13, when it can be determined from the print length that the half-cut position does not reach the half cutter position during printing, the control circuit 12 may determine that printing is performed first, while when it can be determined that the half-cut position reaches the half cutter position, the control circuit 12 may determine that the half cut is performed first.

When determining that the half cut is performed first (YES in step S13), the control circuit 12 performs processing from step S14 to step S17, and step S22 and step S23. These processing steps are the same as processing step S1 to step S6 illustrated in FIG. 7, and the states of the thermal tape 42 after the processing steps are as illustrated in FIG. 8(*b*) to FIG. 8(*g*).

On the other hand, when determining that the half cut is not performed first, i.e., that the printing is performed first (NO in step S13), the control circuit 12 causes the platen roller 7 to feed the thermal tape 42 backward until the printing start area of the thermal tape 42 reaches the head position of the thermal head 8 (step S18).

In the state illustrated in FIG. 10(*a*), where the tip 42T of the thermal tape 42 is at the full cutter position, the printing start area is located on the downstream side of the thermal head 8 in the feeding direction. Therefore, in step S18, the control circuit 12 controls the feeding motor driving circuit 31 to rotate the platen roller 7 backward so as to feed the printing start area to the head position. FIG. 10(*b*) illustrates a state of the thermal tape 42 upon completion of feeding in step S18.

When the feeding is completed, the control circuit 12 performs printing control (step S19). Here, the control circuit 12 controls the feeding motor driving circuit 31 and the head drive circuit 16 to cause the thermal head 8 to perform printing based on print data while rotating the platen roller 7 forward to feed the thermal tape 42. FIG. 10(*c*) illustrates a state of the thermal tape 42 upon completion of printing in step S19.

When the printing is performed, the control circuit 12 then causes the platen roller 7 to feed the thermal tape 42 until the half-cut position of the thermal tape 42 reaches the half cutter position (step S20).

In the state illustrated in FIG. 10(*c*), where the printing is completed, the half-cut position is located on the upstream side of the half cutter 10 in the feeding direction. Therefore, in step S20, the control circuit 12 controls the feeding motor driving circuit 31 to rotate the platen roller 7 forward so as to feed the half-cut position to the half cutter position. FIG. 10(*d*) illustrates a state of the thermal tape 42 upon completion of feeding in step S20.

When the feeding is completed, the control circuit 12 controls the cutter motor driving circuit 34 to cause the half cutter 10 to perform a half cut on the thermal tape 42 (step S21). FIG. 10(*e*) illustrates a state of the thermal tape 42 upon completion of the half cut in step S21.

When the half cut is performed, the control circuit 12 then causes the platen roller 7 to feed the thermal tape 42 until the full-cut position of the thermal tape 42 reaches the full cutter position (step S22).

In the state illustrated in FIG. 10(*e*), where the half cut is completed, the full-cut position is located on the upstream side of the full cutter 9 in the feeding direction. Therefore, in step S22, the control circuit 12 controls the feeding motor driving circuit 31 to rotate the platen roller 7 forward so as to feed the full-cut position to the full cutter position. FIG. 10(*f*) illustrates a state of the thermal tape 42 upon completion of feeding in step S22.

When the feeding is completed, the control circuit 12 controls the cutter motor driving circuit 34 to cause the full cutter 9 to perform a full cut on the thermal tape 42 (step S23). Thus, the thermal tape 42 is cut, and a label as a tape piece separated from the thermal tape 42 as a continuous medium is created. FIG. 10(*g*) illustrates a state of the thermal tape 42 upon completion of the full cut in step S23.

As described above, in the processing illustrated in FIG. 9, the printing can be performed without stopping the feeding in the middle of printing in the same way as in the processing illustrated in FIG. 7. Thus, according to the printing device 1, the processing illustrated in FIG. 9 can be performed to prevent the deterioration of print quality due to the half cut.

Further, the processing illustrated in FIG. 9 is the same as the processing illustrated in FIG. 7 in that the platen roller 7 is rotated backward before the start of printing until the printing start area reaches the head position. Thus, according to the printing device 1, the processing illustrated in FIG. 9 can be performed to prevent the creation of a label having an excessive margin, and hence prevent a wasteful use of the thermal tape 42, like in the case where the processing illustrated in FIG. 7 is performed.

Further, in the processing illustrated in FIG. 9, it is determined, based on print data, which of printing and a half cut is performed first. For example, when the print length PL2 is short as illustrated in FIG. 10(*g*), printing is performed prior to the half cut. This can lead to reducing the amount of backward feeding required for the creation of a label, and hence preventing wasted feeding. Thus, according to the printing device 1, the processing illustrated in FIG. 9 can be performed to shorten the amount of time to create the label.

In step S13 of FIG. 9, although an example of determining, based on the print length, whether to perform the half cut first is illustrated, whether the half cut is performed first may be determined based on print data. For example, a distance from the printing start area to the last printing line (distance PL1*a* in FIG. 8(*g*), distance PL2*a* in FIG. 10(*g*), or the like) may be calculated from the print data instead of the print length to determine, based on the distance, whether the half cut is performed first. In this case, whether the feeding is stopped in the middle of printing can be determined more correctly. Therefore, for example, even when many blank lines are included in the latter part of the printing area, which of printing and the half cut is performed first can be determined properly, and hence wasted feeding can be prevented.

Third Embodiment

Figure 11:
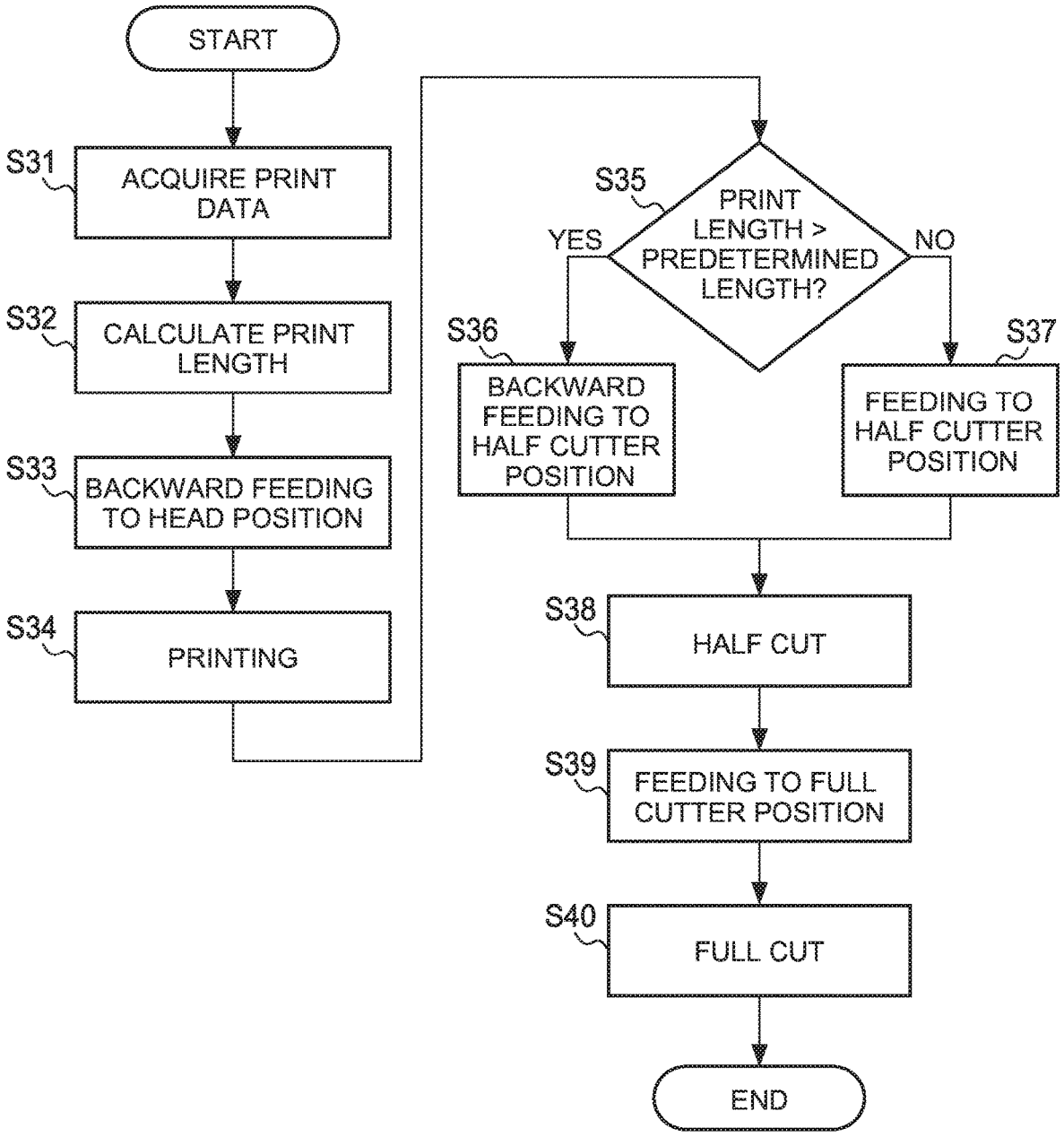
FIG. 11 is an example of a flowchart of processing according to a third embodiment.
Figure 12:
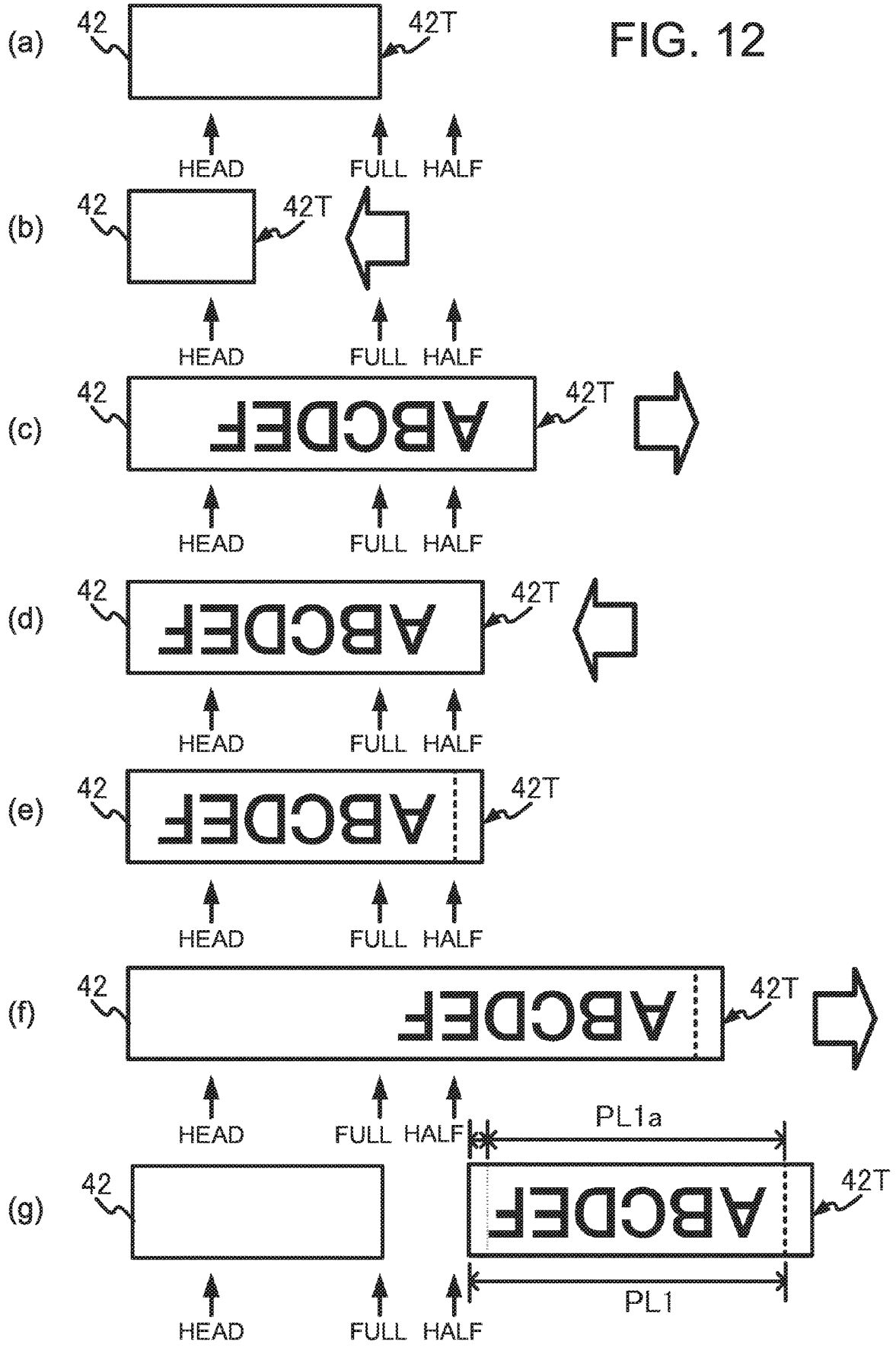
FIG. 12 is a diagram for describing a state of the thermal tape 42 in each processing step illustrated in FIG. 11.

FIG. 11 is an example of a flowchart of processing according to a third embodiment. FIG. 12 is a diagram for describing a state of the thermal tape 42 in each processing step illustrated in FIG. 11. The processing illustrated in FIG.

11 is different from the processing illustrated in FIG. 9 in that printing is performed prior to a half cut regardless of the print length. The processing performed by the printing device 1 will be specifically described below with reference to FIG. 10 to FIG. 12.

In the printing device 1, when a print command is input, the control circuit 12 starts the processing illustrated in FIG. 11, for example, by reading a program stored in the ROM 13 into the RAM 14 and executing the program. Like FIG. 10(*a*), FIG. 12(*a*) illustrates a state of the thermal tape 42 at the start of the processing illustrated in FIG. 11. In this state, the tip 42T of the thermal tape 42 is located at the full cutter position.

The control circuit 12 first acquires print data (step S31), and calculates a print length based on the print data (step S32). These processing steps are the same as the processing step S11 and step S12 illustrated in FIG. 9.

After that, the control circuit 12 causes the platen roller 7 to feed the thermal tape 42 backward until the printing start area of the thermal tape 42 reaches the head position of the thermal head 8 (step S33).

In the state illustrated in FIG. 10(*a*) and FIG. 12(*a*), where the tip 42T of the thermal tape 42 is at the full cutter position, the printing start area is located on the downstream side of the thermal head 8 in the feeding direction. Therefore, in step S33, the control circuit 12 controls the feeding motor driving circuit 31 to rotate the platen roller 7 backward so as to feed the printing start area to the head position. FIG. 10(*b*) and FIG. 12(*b*) illustrate a state of the thermal tape 42 upon completion of feeding in step S33.

When the feeding is completed, the control circuit 12 performs printing control (step S34). Here, the control circuit 12 controls the feeding motor driving circuit 31 and the head drive circuit 16 to cause the thermal head 8 to perform printing based on the print data while rotating the platen roller 7 forward to feed the thermal tape 42. FIG. 10(*c*) and FIG. 12(*c*) illustrate a state of the thermal tape 42 upon completion of printing in step S34.

When the printing is performed, the control circuit 12 then determines whether the print length calculated in step S32 is longer than a predetermined length (step S35). Here, the predetermined length is, for example, a distance between the thermal head 8 and the half cutter 10.

When the print length is longer than the predetermined length (YES in step S35), the half-cut position is located on the downstream side of the half cutter position in the feeding direction upon completion of printing as illustrated in FIG. 12(*c*). In this case, the control circuit 12 rotates the platen roller 7 backward to cause the platen roller 7 to feed the thermal tape 42 backward until the half-cut position reaches the half cutter position (step S36). FIG. 12(*d*) illustrates a state of the thermal tape 42 upon completion of feeding in step S36.

On the other hand, when the print length is equal to or less than the predetermined length (NO in step S35), the half-cut position is located on the upstream side of the half cutter position in the feeding direction upon completion of printing as illustrated in FIG. 10(*c*). In this case, the control circuit 12 rotates the platen roller 7 forward to cause the platen roller 7 to feed the thermal tape 42 until the half-cut position reaches the half cutter position (step S37). FIG. 10(*d*) illustrates a state of the thermal tape 42 upon completion of feeding in step S37.

When the feeding is completed, the control circuit 12 controls the cutter motor driving circuit 34 to cause the half cutter 10 to perform a half cut on the thermal tape 42 (step S38). FIG. 10(*e*) and FIG. 12(*e*) illustrate a state of the thermal tape 42 upon completion of the half cut in step S38.

When the half cut is performed, the control circuit 12 then causes the platen roller 7 to feed the thermal tape 42 until the full-cut position of the thermal tape 42 reaches the full cutter position (step S39).

In the state of FIG. 10(*e*) and FIG. 12(*e*), where the half cut is completed, the full-cut position is located on the upstream side of the full cutter 9 in the feeding direction. Therefore, in step S39, the control circuit 12 controls the feeding motor driving circuit 31 to rotate the platen roller 7 forward so as to feed the full-cut position to the full cutter position. FIG. 10(*f*) and FIG. 12(*f*) illustrate a state of the thermal tape 42 upon completion of feeding in step S39.

When the feeding is completed, the control circuit 12 controls the cutter motor driving circuit 34 to cause the full cutter 9 to perform a full cut on the thermal tape 42 (step S40). Thus, the thermal tape 42 is cut, and hence a label as a piece of tape separated from the thermal tape 42 as a continuous medium is created. FIG. 10(*g*) and FIG. 12(*g*) illustrate a state of the thermal tape 42 upon completion of the full cut in step S40.

As described above, in the processing illustrated in FIG. 11, printing can be performed without stopping the feeding in the middle of printing like in the processing illustrated in FIG. 7 and FIG. 9. Thus, according to the printing device 1, the processing illustrated in FIG. 11 can be performed to prevent the deterioration of print quality due to the half cut.

Further, the processing illustrated in FIG. 11 is the same as the processing illustrated in FIG. 7 and FIG. 9 in that the platen roller 7 is rotated backward before the start of printing until the printing start area reaches the head position. Thus, according to the printing device 1, the processing illustrated in FIG. 11 can be performed to prevent the creation of a label having an excessive margin, and hence prevent a wasteful use of the thermal tape 42.

Fourth Embodiment

Figure 13:
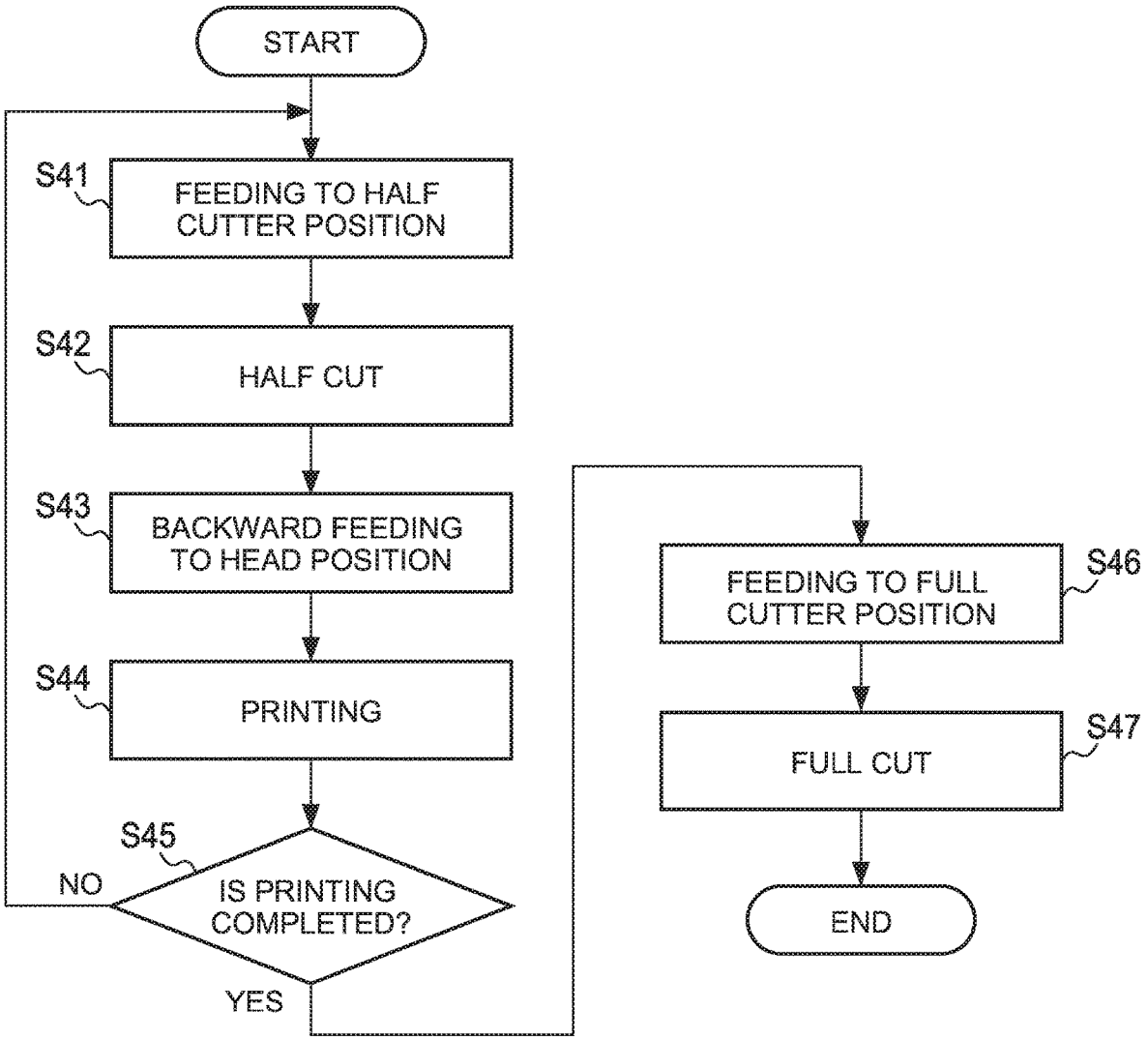
FIG. 13 is an example of a flowchart of processing according to a fourth embodiment.
Figure 14:
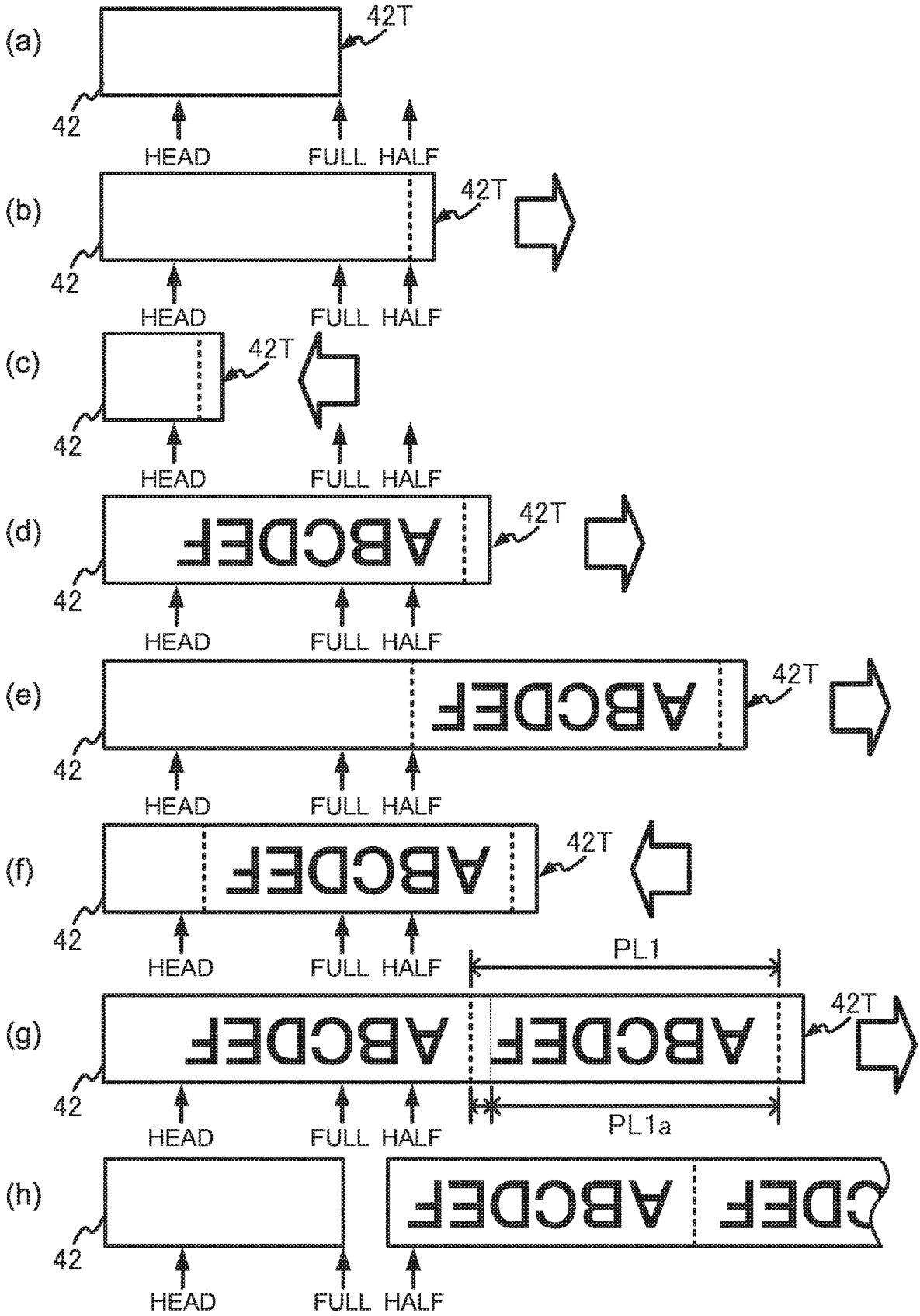
FIG. 14 is a diagram for describing a state of the thermal tape 42 in each processing step illustrated in FIG. 13.

FIG. 13 is an example of a flowchart of processing according to a fourth embodiment. FIG. 14 is a diagram for describing a state of the thermal tape 42 in each processing step illustrated in FIG. 13. The processing illustrated in FIG. 13 is different from the processing illustrated in FIG. 7 in that continuous printing is performed to create plural labels. The processing performed by the printing device 1 will be specifically described below with reference to FIG. 13 and FIG. 14.

In the printing device 1, when a print command is input, the control circuit 12 starts the processing illustrated in FIG. 13, for example, by reading a program stored in the ROM 13 into the RAM 14 and executing the program. FIG. 14(*a*) illustrates a state of the thermal tape 42 at the start of the processing illustrated in FIG. 13. In this state, the tip 42T of the thermal tape 42 is located at the full cutter position.

The control circuit 12 first performs processing from step S41 to step S44. These processing steps are the same as processing step S1 to step S4 illustrated in FIG. 7. FIG. 14(*b*) to FIG. 14(*d*) illustrate states of the thermal tape 42 after the processing step S42, step S43, and step S44, respectively.

After that, the control circuit 12 determines whether printing is completed (step S45), and repeats the processing from step S41 to step S44 until printing for a set number of prints is completed. In step S41 in the second round or later, the control circuit 12 rotates the platen roller 7 forward until a half-cut position (hereinafter called the second half-cut position) located upstream of the printing start area in the feeding direction after being printed reaches the half cutter position. In other words, the control circuit 12 causes the platen roller 7 to feed the thermal tape 42 in the forward direction until the second half-cut position reaches the half cutter position. FIG. 14(*e*), FIG. 14(*f*), and FIG. 14(*g*) illustrate states of the thermal tape 42 after the second round of step S42, step S43, and step S44, respectively.

When the printing is completed, the control circuit 12 then causes the platen roller 7 to feed the thermal tape 42 until the full-cut position of the thermal tape 42 reaches the full cutter position (step S46), and controls the cutter motor driving circuit 34 to cause the full cutter 9 to perform a full cut on the thermal tape 42 (step S47). FIG. 14(*h*) illustrates a state of the thermal tape 42 after the processing step S47.

As described above, in the processing illustrated in FIG. 13, even when continuous printing for plural prints is performed, the printing can be performed without stopping the feeding in the middle of printing like in the processing illustrated in FIG. 7, FIG. 9, and FIG. 11. Thus, according to the printing device 1, the processing illustrated in FIG. 13 can be performed to prevent the deterioration of print quality due to the half cut.

Further, the processing illustrated in FIG. 13 is the same as the processing illustrated in FIG. 7, FIG. 9, and FIG. 11 in that the platen roller 7 is rotated backward until the printing start area reaches the head position before the start of printing. Thus, according to the printing device 1, the processing illustrated in FIG. 13 can be performed to prevent the creation of labels having excessive margins, and hence prevent a wasteful use of the thermal tape 42.

The above-described embodiments are just to illustrate specific examples in order to facilitate the understanding of the invention, and the present invention is not limited to these embodiments. Various modifications and changes can be made to the printing device, the control method, and the program without departing from the scope of claims.

In the above-described embodiments, although the printing device 1 having the input unit 3 and the display unit 6 is exemplified, the printing device may not have the input unit and the display unit, and may receive the print data and the print command from an electronic device different from the printing device.

In the above-described embodiments, the example in which the half-cut position is provided on the downstream side of the printing area in the feeding direction is illustrated, but the half-cut position may be provided on the upstream side of the printing area in the feeding direction. In other words, a half-cut line has only to be made near either one of the edges of a tape piece created by full cut.

In the first embodiment and the fourth embodiment, the example of performing printing after the half cut is illustrated. In the second embodiment, the example of determining, according to print data, which of the half cut and the printing is performed first is illustrated. In the third embodiment, the example of performing the half cut after the printing is illustrated. Thus, in the printing device 1, the control circuit 12 can perform either one of the printing and the half cut first. After either one of the printing and the half cut is performed, the control circuit 12 causes the platen roller 7 to feed the thermal tape 42 in a direction opposite to a direction of ejecting the thermal tape 42 into the outlet until the thermal tape 42 reaches a position at which the other one of the printing and the half cut is performed so that the printing can be performed without stopping the feeding in the middle of printing.

What is claimed is:

1. A printing device comprising:

a feeding roller which feeds a tape member;

a print head which performs printing on the tape member;

a half cutter which performs a half cut on the tape member;

a full cutter which performs a full cut on the tape member; and a control unit which calculates a print length based on acquired print data, and determines, based on the calculated print length, which of the printing and the half cut is to be performed first, wherein:

when the control unit determines that the half cut is to be performed first, the control unit controls the feeding roller to feed the tape member in a backward direction opposite to a direction of ejecting the tape member into an outlet until a printing start area of the tape member reaches a head position of the print head after the half cut is performed, and the control unit causes the print head to perform printing on the tape member after the printing start area reaches the head position by the feeding of the tape member in the backward direction.

2. The printing device according to claim 1, wherein the control unit causes the feeding roller to feed the tape member in a forward direction until a half-cut position of the tape member reaches a cutter position of the half cutter before the half cut is performed.

3. The printing device according to claim 2, wherein when continuous printing is performed, the control unit causes the feeding roller to feed the tape member in the forward direction until a second half-cut position of the tape member, which is located upstream of the printing start area in a feeding direction, reaches the cutter position after the printing is performed.

4. The printing device according to claim 1, wherein when the control unit determines that the printing is to be performed first, the control unit causes the feeding roller to feed the tape member in a forward direction after the printing is performed until a half-cut position of the tape member reaches a cutter position of the half cutter.

5. The printing device according to claim 1, wherein when the control unit determines, based on the calculated print length, that a half cut position of the tape member will reach a cut position of the half cutter during printing when the printing is started from the printing start area, the control unit determines that the half cut is to be performed first.

6. The printing device according to claim 1, wherein the full cutter is provided between the print head and the half cutter along the direction of ejecting the tape member.

7. A printing device comprising:

a control unit;

a feeding roller which feeds a tape member;

a print head which performs printing on the tape member;

a half cutter which performs a half cut on the tape member; and a full cutter which performs a full cut on the tape member, wherein the control unit calculates a print length based on acquired print data, and determines, based on the calculated print length, which one of the printing and the half cut is to be performed first, and wherein after the one of the printing and the half cut is performed, the control unit causes the feeding roller to feed the tape member in a backward direction opposite to a direction of ejecting the tape member into an outlet until the tape member reaches a position at which the other one of the printing and the half cut is performed.

8. A control method implemented by a printing device including a control unit, a print head, a half cutter, and a full cutter, the method comprising:

acquiring print data;

calculating a print length based on the acquired print data;

determining, based on the calculated print length, which of printing and a half cut is to be performed first on a tape member; and when it is determined that the half cut is to be performed first:

performing the half cut on the tape member using the half cutter;

feeding the tape member in a backward direction opposite to a direction of ejecting the tape member into an outlet until a printing start area of the tape member reaches a position of the print head after the half cut is performed; and performing printing on the tape member after the printing start area reaches the position of the print head by the feeding of the tape member in the backward direction.

9. A non-transitory recording medium recording a computer readable program executed by a printing device including a control unit, a feeding roller, a print head, a half cutter, and a full cutter, the program causing the control unit to execute:

a process of acquiring print data;

a process of calculating a print length based on the acquired print data;

a process of determining, based on the calculated print length, which of printing and a half cut is to be performed first on a tape member; and when it is determined that the half cut is to be performed first:

a process of performing the half cut on the tape member using the half cutter;

a process of causing the feeding roller to feed the tape member in a backward direction opposite to a direction of ejecting the tape member into an outlet until a printing start area of the tape member reaches a position of the print head after the half cutter performs the half cut on the tape member; and a process of performing printing on the tape member when the printing start area reaches the position of the print head by the feeding of the tape member in the backward direction.

* * * * *